US005126790A

United States Patent [19]

Moore et al.

[11] Patent Number: 5,126,790

[45] Date of Patent: Jun. 30, 1992

[54] APPARATUS AND METHOD FOR PAPER PATH JAM RECOVERY

[75] Inventors: Steven R, Moore; Michael J. Martin; Russell J. Sokac, all of Rochester, N.Y.

[73] Assignee: Xerox Corporation, Stamford, Conn.

[21] Appl. No.: 635,836

[22] Filed: Jan. 3, 1991

[51] Int. Cl.[5] ..... G03G 15/00

[52] U.S. Cl. ..... 355/207; 355/309

[58] Field of Search ..... 355/205-207, 355/308, 309

[56] References Cited

U.S. PATENT DOCUMENTS

| | | | |
|---|---|---|---|
| 3,586,450 | 6/1971 | Hosey et al. | 355/206 |
| 3,970,384 | 7/1976 | Yamamoto et al. | 355/206 |
| 4,176,941 | 12/1979 | Breitenkam | 355/206 |
| 4,247,194 | 1/1981 | Kubota et al. | 355/206 |
| 4,260,904 | 4/1981 | Horie et al. | 355/206 |
| 4,307,957 | 12/1981 | Kitagawa et al. | 355/206 |
| 4,571,069 | 2/1986 | Kimura et al. | 355/206 |
| 4,596,456 | 6/1986 | Ide | 355/206 |
| 4,662,740 | 5/1987 | Komori et al. | 355/206 |

*Primary Examiner*—R. L. Moses

*Attorney, Agent, or Firm*—Finnegan, Henderson, Farabow, Garrett & Dunner

[57] ABSTRACT

A copy machine of the present invention may include a photoreceptor for storing a document image, a transfer station for transferring a stored document image to a sheet of copy paper at a transfer location, a supply tray for storing a quantity of copy sheets, transport rollers for conveyiong copy sheets along a path from the supply tray to the transfer location, a detector for detecting a misfeed in the path and for outputting a misfeed signal, and a controller for preventing an image on the photoreceptor from entering the transfer location upon receipt of the misfeed signal. A method for transferring an image from a source document to a copy sheet may include the steps of scanning the source document to transfer a document image onto a photoreceptor at a recording area, detecting a copy sheet misfeed in a paper path disposed between a copy sheet supply and an image transfer location, preventing the recording area from entering the transfer location when a misfeed is detected, and transferring the scanned image from the photoreceptor to a copy sheet after the misfeed is abated.

8 Claims, 4 Drawing Sheets

FUNCTION OF PRESENT INVENTION
WHEN COPY SHEET MISFEED OCCURS

CONVENTIONAL COPY MACHINE OPERATION SEQUENCE -- NORMAL OPERATION (I.E., NO COPY SHEET MISFEED)

CONVENTIONAL COPY MACHINE OPERATION WHEN COPY MISFEED OCCURS

APPARATUS AND METHOD FOR PAPER PATH JAM RECOVERY

BACKGROUND OF THE INVENTION b 1. Field of the Invention

The invention relates to an improved apparatus and method for document and copy sheet handling in copy machines and other reproduction equipment.

2. Description of the Related Art

During normal operation of conventional copy machines as with the present invention, while a document is being scanned at a scanning station, the image of a previous document on a photoreceptor is simultaneously processed.

As shown in FIG. 3, a document N is scanned on a platen and its image is recorded as a latent image on a photoreceptor (P/R) during a first time period T1. Subsequently, during period T2, a copy sheet N leaves a paper tray and begins traveling towards a transfer station where the image of document N will be transferred to the copy sheet. Also during the time period T2, documents N is replaced by a subsequent document N+1 on the platen.

During time period T3, is the latent image of document N on the photoreceptor is developed at a developing station, while document N+1 is simultaneously scanned on the platen. During time period T4, developed image N on the photoreceptor is transferred to copy sheet N at the transfer station, copy sheet N+1 leaves the paper tray, and latent image N+1 on the photoreceptor is developed. Additionally, document N+2 is scanned on the platen during time period T4.

Finally, during time period T5, image N is cleaned from the photoreceptor at a cleaning station and the photoreceptor is recharged at a recharge station. Simultaneously, developed image N+1 is transferred to copy sheet N+1 at the transfer station, and copy sheet N+2 leaves the paper tray.

The above described sequence, which is typically controlled by a controller within the copy machine, maximizes the efficiency and speed of the machine. However, when a copy paper misfeed occurs in the conventional copy machine, the efficiency of the copy machine suffers greatly.

As depicted in FIG. 4, in a conventional copy machine, when, after document N is replaced by document N+1 on the platen, a copy sheet misfeed occurs, the latent image on the photoreceptor belt is developed with toner. However, since a misfeed has occured in the paper path for supplying the transfer station with copy paper, the developed toner image cannot be transferred to a copy sheet and is therefore cleaned from the photoreceptor belt at the cleaning station. After the paper jam is cleared, the document handler must recirculate all of the documents until documents N reappears on the platen for rescanning.

The conventional copy machine misfeed algorithm is inefficient in three respects. First, it requires the document handler to recirculate the entire set of documents to return the "N" document to the platen. This can be very time consuming especially when a large stack of documents is in the document handler. Second, it requires that the N document be scanned twice, a first time before the misfeed and second time after the misfeed. Third, it requires that the initial developed image of the N document be cleaned from the photoreceptor at a cleaning station. This cleaning contaminates the cleaning station with a large quantity of unused toner. During usual cleaning after image transfer, only about 5% of the toner remains on the photoreceptor belt for cleaning. However, when transfer of the developed image does not occur, nearly 100% of the toned image must be cleaned off of the photoreceptor belt at the cleaning station. This excess toner contaminates the cleaning station and shortens its life.

The objects of the present invention are to provide a method and apparatus for document handling that is more efficient than the apparatus and methods of the prior art.

It is also an object of the present invention to provide a method and apparatus that obviates the need to scan a document twice when a copy sheet misfeed occurs.

It is a further object of the present invention to provide a method and apparatus that does not contaminate the cleaning station with excess toner when a copy sheet misfeed occurs.

It is also an object of the present invention to provide a method and apparatus that does not require the document handler to recirculate an entire set of documents after a copy sheet misfeed.

Additional objects and advantages of the invention will be set forth in part in the description which follows, and in part will be obvious from the description and may be learned by practice of the invention. The objects and advantages of the invention will be realized and attained by means of the elements and combinations particularly pointed out in the appended claims.

SUMMARY OF THE INVENTION

To achieve the objects in accordance with the purpose of the invention as embodied and broadly described herein, the invention comprises a copy machine including photoreceptor means for scanning a document and storing a document image, means for transferring a stored document image to a sheet of copy paper at a transfer location, supply means for storing a quantity of copy sheets, transport means for conveying copy sheets from the supply means to the image transfer portion of the photoreceptor means along a path, means for detecting a misfeed in the path and for outputting a misfeed signal, and control means for preventing an image on the photoreceptor means from entering the transfer location upon receipt of the misfeed signal.

Also in accordance with the purpose of the invention, as embodied and broadly described herein, the invention comprises a method for transferring an image from a source document to a copy sheet comprising the steps of scanning the source document to transfer a document image onto a photoreceptor at a recording location, detecting a copy sheet misfeed in a path disposed between a copy sheet supply and an image transfer location proximate the photoreceptor, preventing the recording area of the photoreceptor from entering the transfer location when a misfeed is detected, abating the detected misfeed, and transferring the scanned image from the photoreceptor to a copy sheet when the misfeed is abated.

It is to be understood that both the foregoing general description and the following detailed description are exemplary and explanatory only and are not restrictive of the invention, as claimed.

The accompanying drawings which are incorporated in and constitute a part of the specification, illustrate embodiments of the invention, and together with the description, serve to explain the principles of the invention.

DESCRIPTION OF THE PREFERRED EMBODIMENTS

Reference will now be made in detail to the present preferred embodiments of the invention, examples of which are illustrated in the accompanying drawings.

Figure 1:
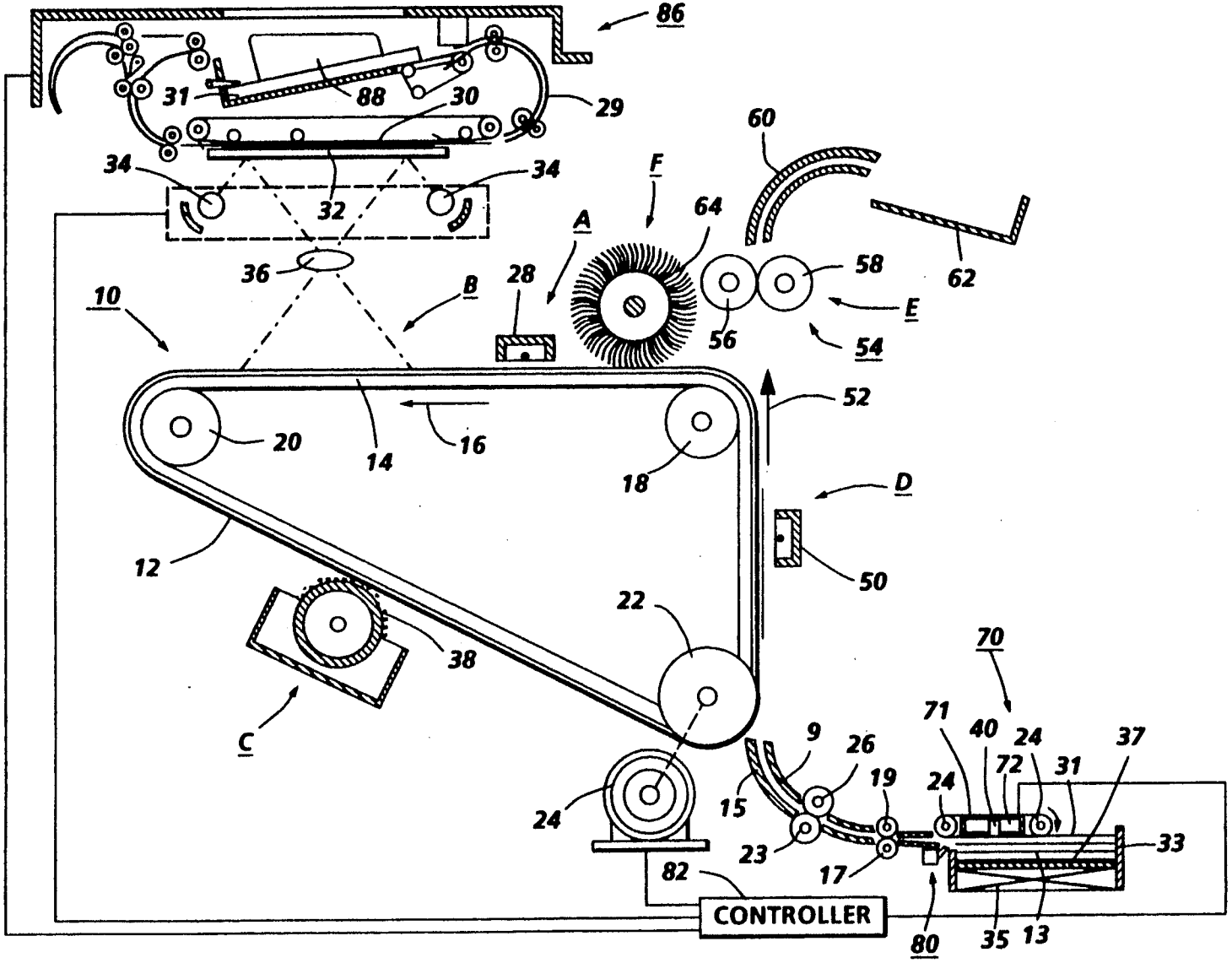
FIG. 1 is a schematic elevational view of the electrophotographic printing machine incorporating the features of the present invention.

FIG. 1 schematically depicts the various components of an electrophotographic printing machine incorporating a top feed vacuum corrugation feeder 70 and a document handler 86. It will become evident from the following discussion that the sheet feeding system disclosed herein is equally well suited for use in a wide variety of devices and is not necessarily limited to its application to the particular embodiments shown herein. For example, the apparatus of the present invention may be readily employed in non-xerographic environments and substrate transportation in general.

Inasmuch as the art of electrophotographic printing is well known, the operation of the various processing stations employed in the printing machine depicted in FIG. 1 will initially be described briefly.

As shown in FIG. 1, the electrophotographic printing machine employs a belt 10 having a photoconducting surface 12 deposited on a conductive substrate 14. Preferably, photoconductive surface 12 is made from an aluminum alloy. Belt 10 moves in the direction of arrow 16 to advance successive portions of photoconductive surface 12 sequentially through the various processing stations disposed about the path of movement thereof. Belt 10 is entrained around stripper roller 18, tension roller 20, and drive roller 22.

Drive roller 22 is mounted rotatably in engagement with belt 10. Roller 22 is coupled to a suitable means such as motor 24 through a belt drive. Motor 24 rotates roller 24 to advance belt 10 in the direction of arrow 16. Drive roller 22 includes a pair of opposed spaced flanges or edge guides (not shown). Preferably, the edge guides are circular members or flanges.

Belt 10 is maintained in tension by a pair of springs (not shown), for resiliently urging tension roller 20 against belt 10 with the desired spring force. Both stripping roller 18 and tension roller 20 are mounted rotatably. These rollers are idlers which rotate freely as belt 10 moves in the direction of arrow 16.

With continued reference to FIG. 1, initially a portion of belt 10 passes through charging station A. At charging station A, a corona generating device, indicated generally by the reference numeral 28, charges photoconductive surface 12 of the belt 10 to a relatively high, substantially uniform potential.

Next, the charged portion of photoconductive surface 12 is advancd through exposure station B. At exposure station B, an original document 30 is positioned face down upon transparent platen 32. This is accomplished by recirculating document handler 86 which moves document 30 from the bottom of stack 31 to platen 32 through baffles 29.

Lamps 34 flash light rays onto original document 30. The light rays reflected from the original document 30 are transmitted through lens 36 to form a light image of document 30. The light image is projected onto the charged portion of the photoconductive surface 12 to selectively dissipate the charge thereon. This records an electrostatic latent image on photoconductive surface 12 which corresponds to the light image of original document 30.

Thereafter, belt 10 advances the elctrostatic latent image recorded on photoconductive surface 12 to development station C. At development station C, a magnetic brush developer roller 38 advances a developer mix into contact with the electrostatic latent image. The latent image attracts the toner particles from the carrier granules forming a toner powder image on a photoconductive surface 12 of belt 10.

Belt 10 then advances the toner powder image to transfer station D. At transfer station D, a sheet of support material such as copy paper is moved into contact with the toner powder image. A copy sheet is advanced toward transfer station D by top vacuum corrugation feeder 70. Preferably, feeder 70 includes an air knife 80 which floats a sheet 31 up to where it is grabbed by the suction force from vacuum plenum 75. A perforated feed belt 71 then forwards the now separated sheet for further processing. The sheet is directed through rollers 17, 19, 23, and 26 into contact with the photoconductive surface 12 of belt 10 in a timed sequence by suitable conventional means so that the toner powder image developed thereon synchronously contacts the advancing copy sheet of at transfer station D.

Transfer station D includes a corona generating device 50 which sprays ions onto the backside of a sheet passing through the station. This attracts the toner powder image from the photoconductive surface 12 to the sheet and provides a normal force which causes photoconductive surface 12 to take over transport of the advancing sheet of support material. After transfer, the sheet continues to move in the direction of arrow 52 onto a conveyor (not shown) which advances the sheet to fusing station E.

Fusing station E includes a fuser assembly, indicated generally by the reference numeral 54, which permanently affixes the transferred toner powder image to the copy sheet. Preferably, fuser assembly 54 includes a heated fuser roller 56 and a backup roller 58. A sheet passes between fuser roller 56 and backup roller 58 with the toner powder image contacting fuser roller 56. In this manner, the toner powder image is permanently affixed to the sheet. After fusing, chute 60 guides the advancing sheet to catch tray 62 for removal from the printing machine by the operator.

Invariably, after the copy sheet is separated from the photoconductive surface 12 of belt 10, some residual particles remain adhering thereto. These residual particles are removed from photoconductive surface 12 at cleaning station F. Cleaning station F includes a rotatably mounted brush 64 in contact with the photoconductive surface 12. The particles are cleaned from photoconductive surface 12 the rotation of brush 64 in contact therewith. Subsequent to cleaning, a discharge lamp (not shown) floods photoconductive surface 12 with light to dissipate any residual electrostatic charge remaining thereon prior to the charging thereof for the next successive image cycle.

In accordance with the present invention there is provided a copy machine comprising photoreceptor means for scanning a document and storing a document image, and means for transferring a stored document image to a sheet of copy paper at a transfer location. As embodied herein, photoreceptor means includes photoreceptor belt 10 having photoconductive surface 12. Photoreceptor means may also include lamps 34 for projecting light rays onto original document 30 to be reflected from original document 30 and projected onto the charged portion of photoconductive surface 12 as described earlier.

The transfer means of the present invention includes corona generating device 50, adjacent which a copy sheet and a developed document image pass, after the image is developed at developing station C.

Also in accordance with the present invention, there is provided supply means for storing a quantity of copy sheets and transport means for conveying copy sheets along a path from said supply means to said image transfer portion of said photoreceptor. As embodied herein, paper supply means includes paper tray 33 for storing a quantity of paper sheets 31. Paper tray 33 may be provided with a conventional elevator mechanism 35 for raising and lowering either tray 33 or platform 37 within tray 33.

As embodied herein, paper transport means includes vacuum corrugation feeder 70. Vacuum corrugation feeder 70 includes vacuum plenum 72 which is positioned over a front top end of paper tray 33. Drive rollers 24 are disposed on opposing sides of vacuum plenum 72, and a belt 71 or a plurality of belts are entrained around drive rollers 24. Perforations disposed in belt 71 allow a suitable vacuum source (not shown) connected to plenum 72 to draw sheets 31 from stack 13 against belt 71.

Air knife 80 applies a positive pressure to the front of stack 13 to separate the top sheet in the stack and enhance its acquisition by vacuum feeder 70. A sheet captured on belts 71 is forwarded into a nip between forwarding drive rollers 17 and 19 for transport to transfer station D through a path defined by baffles 9 and 15.

In accordance with the invention, there is also provided means for detecting a misfeed in the path and for outputting a misfeed signal. The term "misfeed" as used in connection with this application is meant to broadly refer to copy sheet jams, misacquisitions, or any other occurrence that may prevent the travel of a copy sheet from tray 33 to transfer station D.

As embodied herein, detecting means may include detector 40 disposed on vacuum corrugation feeder 70. As described in a related application concurrently filed with the present application, detector 40 may be a vacuum switch connected to vacuum plenum 72 to the vacuum switch is capable of detecting the presence or absence of a sheet against the feed belt by detecting whether a vacuum exists within vacuum plenum 72. When a sheet of paper 31 is not drawn against belt 71 of corrugation feeder 70, air is drawn into vacuum plenum 72 preventing a vacuum from existing within vacuum plenum 72. The absence of a vacuum within plenum 72 allows vacuum detector 40 to remain in a first state. However, when a sheet is drawn against belt 71, air is prevented from entering vacuum plenum 72 through perforations in feed belt 71. Thus, a vacuum occurs within plenum 72 that changes the state of vacuum detector 40.

When the vacuum detector 40 fails to detect the presence of a sheet against belt 71 within a predetermined period, it sends a misfeed signal to controller 82.

In an alternate embodiment, detecting means may include detectors (not shown) disposed along the path between baffles 15 and 19. Should these detectors detect a jam within the path, they may send a misfeed signal to controller 82. In addition, if the detectors fail to detect the presence of a sheet in the path within a predetermined period, they may also transmit a misfeed signal.

In accordance with the present invention, there is provided control means for preventing an image on said photoreceptor means from entering said transfer location upon receipt of said misfeed signal. As embodied herein, control means includes controller 82 which may be electrically connected to motor 24, sheet feeder 70, document handler 86, and exposure station B. When sheet misacquisition or a copy sheet jam is detected, an electric signal is sent to controller 82 from detector 40. Controller 82 then sends signals to document handler 86 and motor 24 to initiate an algorithm such as the one depicted in the flowchart of FIG. 2.

The algorithm of FIG. 2, which will now be described in detail, slows or stops photoreceptor belt 10 to maintain a developed image on photoreceptor belt 10 until a paper jam can be abated. Stopping or slowing photoreceptor belt 10 obviates the need to rescan an original document, the image of which would otherwise be lost when the image on belt 10 passes through cleaning station F.

Figure 2:
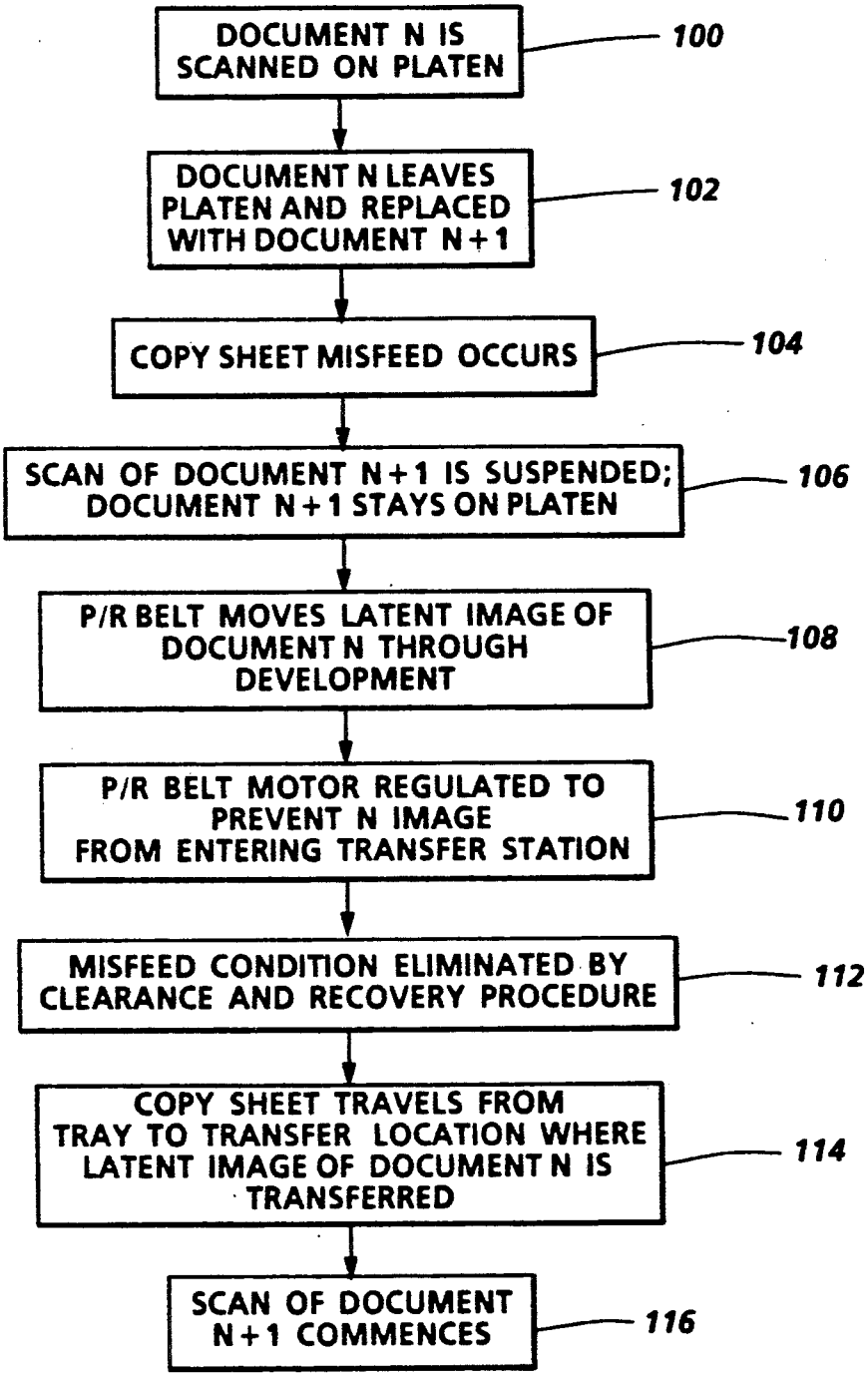
FIG. 2 is a flow diagram depicting the function of the present invention when a copy sheet misfeed occurs.
Figure 3:
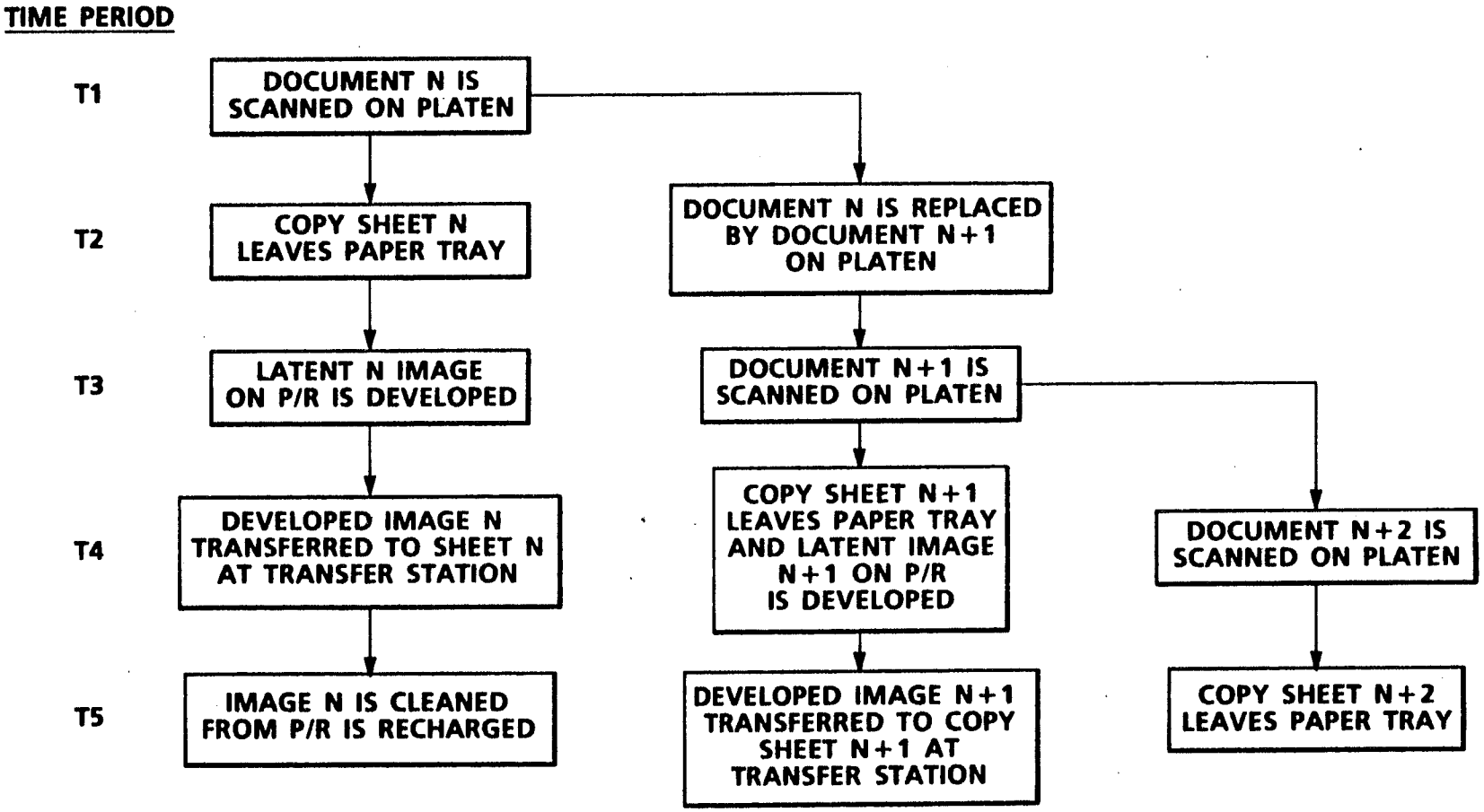
FIG. 3 is a flow diagram depicting the function of the conventional copy machine and the copy machine of the present invention at various time periods during normal operation.
Figure 4:
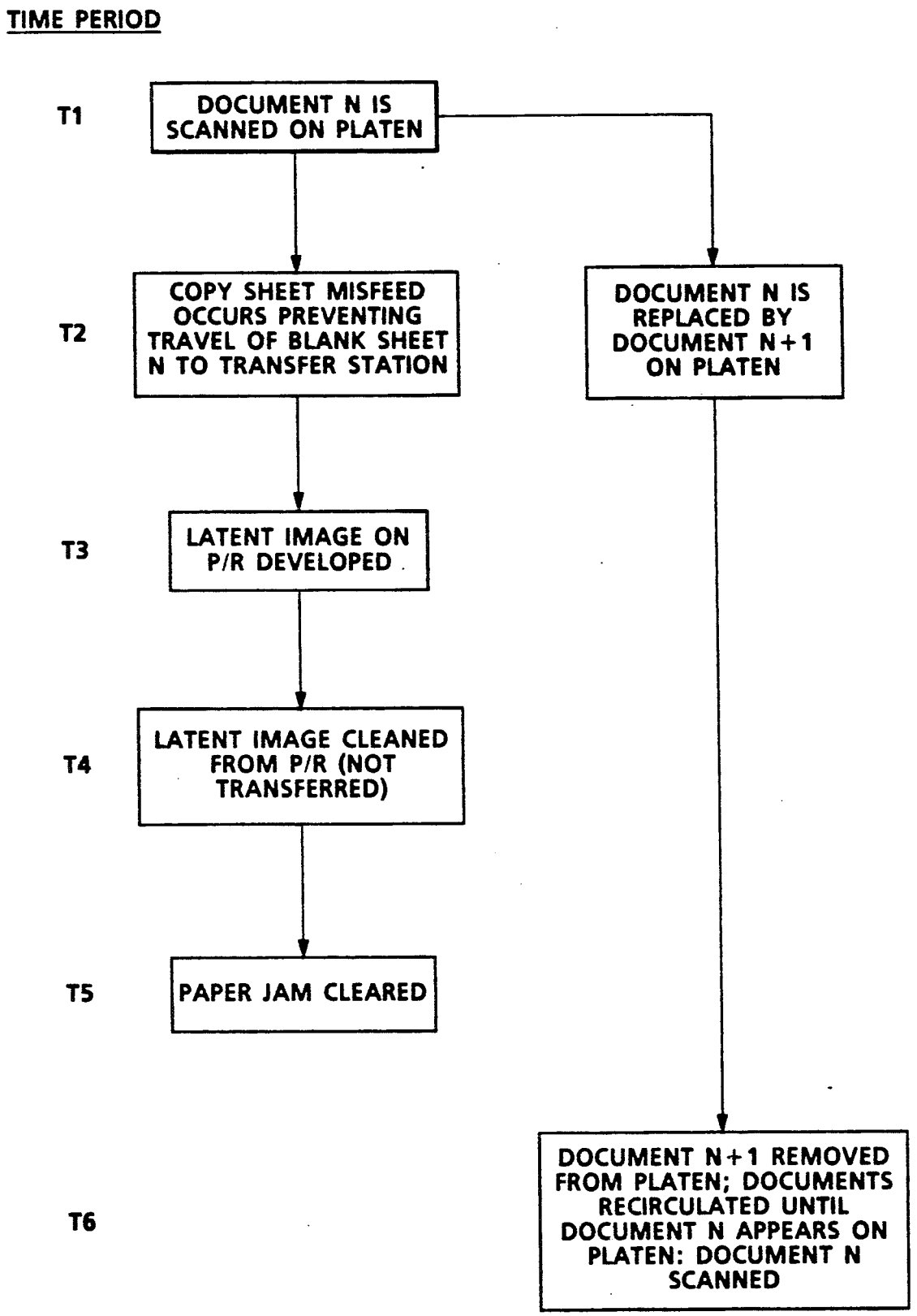
FIG. 4 is a flow diagram depicting conventional copy machine operation when a copy sheet misfeed occurs.

As shown in FIG. 2, after document N is scanned on platen 30 at step 100, document handler 86 returns document N to document tray 88 replacing it on platen 30 with document N+1 as indicated at step 102. Simultaneously, controller 82 is programmed to send a sheet from stack 13 towards transfer station D.

If a copy sheet misfeed occurs as indicated at step 104, the misfeed is detected by a sensor such as vacuum switch 40, and controller 82 sends signals to exposure station B to suspend the scan of document N+1. Simultaneously, controller 82 sends a signal to document handler 86 to leave the N+1 document on platen 32, as indicated in step 106. Controller 82 regulates motor 24 to allow the latest image of document N to pass through development station N as indicated in step 108. However, controller 82 is programmed to prevent a latent image of document N from passing to transfer station D.

If a misfeed such as a misacquisition is detected, controller 82 may slow photoreceptor belt 10 while sheet feeder 70 tries to repick a sheet. If a repick is unsuccessful, or a paper jam occurs in the paper path between baffles 9 and 15, controller 82 may stop or "park" photoreceptor belt 10 as indicated in step 110.

After the misfeed condition is abated by either an automatic or manual clearance and recovery procedure, as indicated at step 112, controller 82 activates sheet feeder 70 and motor 24 to transfer the N document image to a copy sheet transfer station D as indicated at step 114. Controller 82 then sends a signal to scan station B, as indicated in step 116, to commence scanning of the N+1 document that was suspended at step 106. In this manner, document handler 86 does not proceed through a time-consuming routine of recirculating a stack of documents in order to return the N and N+1 documents to the platen.

Controller 82 may be programmed to handle a wide variety of misfeed scenarios. For example, if a misfeed occurs after the N and N+1 documents have been scanned, but before their images have been transferred to copy sheets, controller 82 may park two images on photoreceptor belt 10 until a misfeed condition is eliminated. Depending upon the structure of the copy machine, photoreceptor 10 may be parked after both the N and N+1 images have passed through development station C. In the alternative, photoreceptor belt 10 may be parked after the N image passes through development station C, but before the N+1 image is developed.

Since the "shelf life" of a non-developed image is much shorter than that of a developed image, controller 82 may be programmed to discard the N+1 image if the N+1 image has not been developed within a predetermined period of time. The predetermined period of time will vary depending upon minimum quality requirements and individual characteristics of different photoreceptor belts.

The present invention is especially applicable to printers and digital copiers as well as the photocopiers described above. In a printer, the image is supplied from a network through ESS and ROS. The ROS writes the image on the photoreceptor. In the digital copier, the document is scanned only once and converted into a digital image which is stored in a computer or ESS or print server.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

What is claimed is:

1. A copy machine comprising:

photoreceptor means for scanning a document and storing a document image on a storage portion thereof;

means for transferring a stored document image to a copy sheet at a transfer location;

supply means for storing a quantity of copy sheets;

transport means for conveying copy sheets along a path from said supply means to said transfer location;

means for detecting a misfeed in said path and for outputting a misfeed signal in response thereto; and control means for preventing an image on said storage portion of said photoreceptor means from entering said transfer location upon receipt of said misfeed signal, and for enabling transfer of said stored image to a copy sheet upon abatement of the misfeed.

2. A copy machine as set forth in claim 1, further including document handling means for transporting documents in seriatum to a scanning portion proximate said photoreceptor means, said scanning portion including a platen for supporting documents during scanning by said photoreceptor means.

3. A copy machine as set forth in claim 2 further including means for preventing said document handling means from removing a document from said platen when said control means receives said misfeed signal.

4. A copy machines as set forth in claim 1, wherein said photoreceptor means includes a photoreceptor belt for storing images thereon.

5. A method for transferring an image from a source document to a copy sheet, comprising the steps of:

scanning the source document at a scanning location to record a document image on a photoreceptor at a recording area;

detecting a copy sheet misfeed in a path between a copy sheet supply and an image transfer location;

preventing the recording area of the photoreceptor from entering the transfer location when a misfeed is detected; and transferring said scanned image from the photoreceptor to a copy sheet after the detected misfeed is abated.

6. A method according to claim 5, further including the steps of circulating documents toward and away from the scanning location with a document handler and preventing said circulation by said document handler when a misfeed is detected.

7. A method for transferring an image from a source document to a copy sheet, comprising the steps of:

transporting a first source document from a document handler to platen;

scanning said first source document on said platen to transfer a first document image onto a photoreceptor;

transporting said first document away from said platen;

transporting a second source document onto said platen; detecting a copy sheet misfeed in a paper path between a copy sheet source and an image transfer region proximate said photoreceptor; and transferring said first document image to a copy sheet in response to abatement of said detected copy sheet misfeed, while maintaining said second source document on said platen.

8. A method according to claim 7, wherein photoreceptor includes a photoreceptor belt for storing the first document image on a movable storage portion thereof, the method further comprising the step of preventing the movable storage portion from entering the image transfer region when a copy sheet misfeed is detected.

* * * * *